United States Patent [19]

Frantzreb, Sr.

[11] 4,175,918

[45] Nov. 27, 1979

[54] ELONGATE CONSOLIDATED ARTICLE AND METHOD OF MAKING

[75] Inventor: John G. Frantzreb, Sr., Peoria, Ill.

[73] Assignee: Caterpillar Tractor Co., Peoria, Ill.

[21] Appl. No.: 859,497

[22] Filed: Dec. 12, 1977

[51] Int. Cl.[2] ..... B22F 3/00

[52] U.S. Cl. ..... 428/567; 425/576; 75/229; 75/DIG. 1; 75/53; 75/58; 75/93 G; 75/102

[58] Field of Search ..... 75/229, DIG. 1, 208, 75/214, 53, 58, 93 G, 102 R, 102 A; 428/567, 576

[56] References Cited

U.S. PATENT DOCUMENTS

| | | | |
|---|---|---|---|
| 2,756,492 | 7/1956 | Pettibone | 428/558 |
| 3,278,281 | 10/1966 | Ehringer | 75/229 |
| 3,282,658 | 11/1966 | Wainer | 75/DIG. 1 |
| 3,450,510 | 6/1969 | Calow | 75/208 CS |
| 3,729,794 | 5/1973 | Douglass | 428/567 |
| 3,815,224 | 6/1974 | Pickus et al. | 428/567 |
| 3,887,365 | 6/1975 | Sherfey | 75/DIG. 1 |
| 3,921,700 | 11/1975 | Frantzreb et al. | 29/191.6 |

*Primary Examiner*—Brooks H. Hunt
*Attorney, Agent, or Firm*—John W. Grant

[57] ABSTRACT

An elongate consolidated article for treating molten metal has a multiplicity of elongate fibers embedded within a coherent matrix of treating agent.

7 Claims, 1 Drawing Figure

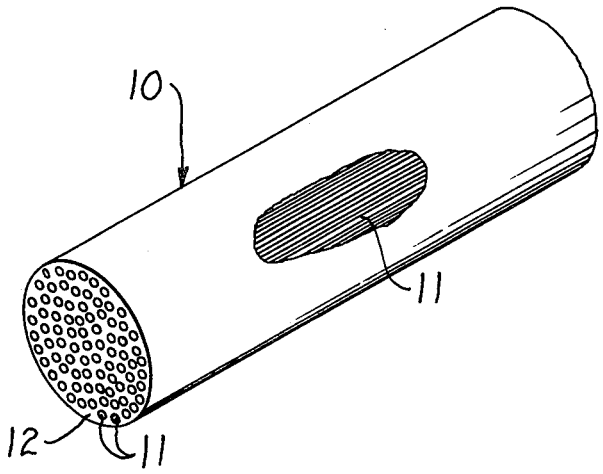
10
11
12
11

ELONGATE CONSOLIDATED ARTICLE AND METHOD OF MAKING

BACKGROUND OF THE INVENTION

This invention relates to an elongate consolidated article for treating molten metal for altering same and a method of making the article.

One process for treating molten iron for altering same includes enclosing the powdered treating agent within a relatively thick walled metal conduit thereby forming a wire-like article which is inserted into the molten iron at a preselected controlled feed rate. The molten iron dissolves the conduit thereby releasing the treating agent into the molten iron. The conduit is commonly made of steel because of the high ductility of steel and because it does not alter the composition of the molten iron to any significant degree.

One of the problems encountered with that process is that the melting point of the steel conduit is higher than the normal pour temperature of the molten iron and the steel conduit is dissolved by the combination of solid state diffusion and melting reaction. The time required to melt through the relatively thick walled conduit undesirably delays the final dissolution of the article in the molten iron and undesirably limits the maximum permissible feed rate. The use of a conduit having a relatively thin wall is not practical since the process commonly used to make the wire-like article leaves a seam which has a tendency to split open thereby allowing the treating agent to spill out when the article is coiled onto a reel.

SUMMARY OF THE INVENTION

The present invention is directed to overcoming one or more of the problems as set forth above.

According to this invention, an elongate consolidated article is provided for the introduction of a treating agent into molten metal for altering the molten metal. The article has elongate fibers embedded within a matrix in a manner sufficient for holding the matrix together as a whole and for resisting separation of the article in response to bending of the article. Also, the elongate fibers are readily meltable and the treating agent released into the molten metal in response to the article being inserted into the molten metal.

BRIEF DESCRIPTION OF THE DRAWING

The sole FIGURE is an isometric view partially in section of a consolidated article constructed in accordance with the present invention.

DETAILED DESCRIPTION

Referring to the drawing, an elongate consolidated article 10 has a multiplicity of elongate fibers 11 embedded within a coherent matrix 12 of treating agent. The elongate fibers extend generally along a longitudinal axis of the article.

The elongate fibers are preferably metallic and can comprise about 30% to about 55% by volume of the article and preferably comprise about 50% by volume of the article. When the volume of metallic fibers is less than about 30%, the mechanical strength and structural integrity of the article is insufficient for its intended use. When the volume is greater than about 55%, the efficiency and effectiveness of the article is reduced since the amount of treating agent per unit length is reduced. The metallic fibers can be formed from metals which can be readily extruded and stretched when they are heated sufficient to become plastic. Such metals can be either ferrous such as iron and steel, or nonferrous such as aluminum and copper. Preferably, the metallic fibers are formed from a low carbon, mild steel.

The term "treating agent" as used includes the element or elements which actually alter the molten metal together with any trace elements, carriers or binders which may be present in or added to commercial treating materials.

The type of treating agent in the article 10 is dependent upon the base molten metal to be treated and the desired metallurgical characteristics of the resultant product. For example, for inoculating an iron to produce gray iron the treating agent can consist essentially of ferrosilicon. Two examples of such ferrosilicon treating agents are set fourth below.

| Example No. 1 | | Example No. 2 | |
|---|---|---|---|
| Silicon | 74–79% | Silicon | 60–65% |
| Aluminum | 1.00–1.50% | Aluminum | 0.75–1.25% |
| Calcium | .50–1.00% | Calcium | 1.5–2.5% |
| Iron | Balance | Manganese | 5.7% |
| | | Zirconium | 5–7% |
| | | Barium | 2–3% |
| | | Iron | Balance |

Example 1 is identified as "Grade 75% ferrosilicon" and Example 2 is identified as "SMZ alloy" both of which are manufactured by Union Carbide Corporation, Ferroalloys Division, Buffalo, N.Y. The ferrosilicon used in the present article can have a silicon content between about 55% and 85% by weight of the treating agent with a silicon content of about 75% being preferred. When the silicon content is below about 55%, the treating agent is inefficient and will not inoculate the iron properly. When the silicon content is above 85% the treating agent causes an exothermic reaction and can undesirably raise the temperature of the molten iron.

As noted in the above examples, the treating agent can also contain small portions of one or more trace elements for producing a specific resultant product. Trace elements that have been found to be useful in the treating agent used in article 10 includes strontium, barium, aluminum, cerium, calcium, and rare earth alloys among others.

A third example for treating a molten iron for producing a nodular cast iron is a magnesium ferrosilicon treating agent as set forth below. The third example is also manufactured by Union Carbide Corporation.

| Example No. 3 | |
|---|---|
| Magnesium | 8–10% |
| Silicon | 44–48% |
| Iron | Balance |

In one example article having a diameter of about 0.125 inches (3.175 mm), the metallic fibers comprise about 50% by volume of the article and are formed from low carbon, mild steel. The metallic fibers are about 0.001 inches (0.025 mm) in diameter and are about 8 inches (203.2 mm) long. The treating agent is essentially a ferrosilicon having a silicon content of about 75% by weight of the treating agent.

In carrying out the method of making the elongate consolidated article 10 described above, the steps include mixing metallic particles and the treating agent into a uniform mix. Preferably, the metallic particles are in the form of wires about 0.003 to 0.004 inches (0.076 to 0.102 mm) in diameter and about 2 to 3 inches (50.8 to 76.2 mm) in length or small shot having sufficient mass to be extruded into metallic fibers of about 0.001 inches (0.025 mm) in diameter and from 6 to 10 inches (152 to 254 mm) long. The uniform mix is then encapsulated within a thin walled steel container having a wall thickness of less than about 0.010 inches (0.254 mm). The container and hence the uniform mix contained therein is then compacted into a dense billet having a density greater than about 80% of the theoretical density of the mix to drive the air from the mix. Suitable vents can be incorporated in the container to permit the trapped air to escape during compaction. The billet is then heated to just below the solidus point of the treating agent. In the preferred example in which the treating agent is Grade 75% ferrosilicon, the billet is heated to about 1205° C. The hot billet is then rolled in powdered glass which fuses to the surface of the hot thin walled container. The hot billet with the powdered glass fused to the container is then extruded through a die for stretching the metallic particles into elongate metallic fibers, coalescing and densifying the mix into an elongate coherent matrix and embedding the fibers within the matrix. Advantageously, the extrusion process aligns the fibers generally along a longitudinal axis of the article.

The coherent matrix is formed by a resultant instantaneous rise in temperature of the treating agent above its melting point as the billet is extruded through the die. The glass powder fused to the container acts as a die lubricant during the extrusion step. The container emerges from the die as a tissue thin covering on the consolidated article. However, the temperature of the covering is relatively high such that the covering is attacked by the air, causing it to crystallize and flake off the article.

The article made from the above process will possess excellent mechanical properties and can be inserted below the surface of molten metal yet dissolve and melt quickly without losses due to burning in the atmosphere. The metal fibers are in a form which melt at a rate so as not to delay the final dissolution of the article in the molten metal. The elongate metallic fibers extending along the longitudinal axis of the article will hold the matrix together as a whole without the use of a metal sheath and will provide a resultant article which resists separation of the matrix in response to bending of the article such as when the article is coiled onto a reel.

Other aspects, objects and advantages of this invention can be obtained from a study of the drawings, the disclosure and the appended claims.

The embodiments of the invention in which an exclusive property or privilege is claimed are defined as follows:

1. An elongate consolidated article for controlled insertion into a molten iron for altering same comprising:

a coherent matrix including a treating agent consisting essentially of a ferrosilicon; and a multiplicity of elongate metallic fibers embedded within the matrix, said elongate metallic fibers extending generally along a longitudinal axis of the article and being formed from a ferrous material which will melt in the heat range of molten iron.

2. The article of claim 1 wherein the elongate metallic fibers comprise from about 30% to about 55% by volume of the article.

3. The article of claim 2 wherein the elongate metallic fibers comprise about 50% by volume of the article.

4. The article of claim 1 wherein the ferrosilicon has a silicon content of between 55% and 85% by weight of the treating agent.

5. The article of claim 4 wherein the silicon content is about 75% by weight of the treating agent.

6. The article of claim 4 wherein the treating agent has at least one trace element selected from the group consisting of strontium, barium, calcium, cerium, aluminum and rare earth alloys.

7. The article of claim 1 wherein the elongate metallic fibers comprise about 50% by volume of the article and are formed from low carbon, mild steel, said ferrosilicon has a silicon of about 75% by weight of the treating agent.

* * * * *